US011401718B2

(12) United States Patent
Ziegler et al.

(10) Patent No.: US 11,401,718 B2
(45) Date of Patent: Aug. 2, 2022

(54) BRIGHT COLOURED SURFACE LAYER

(71) Applicant: Välinge Innovation AB, Viken (SE)

(72) Inventors: Goran Ziegler, Viken (SE); Kent Lindgren, Perstorp (SE)

(73) Assignee: VALINGE INNOVATION AB, Viken (SE)

( * ) Notice: Subject to any disclaimer, the term of this patent is extended or adjusted under 35 U.S.C. 154(b) by 148 days.

(21) Appl. No.: 14/563,167

(22) Filed: Dec. 8, 2014

(65) Prior Publication Data

US 2015/0093502 A1 Apr. 2, 2015

Related U.S. Application Data

(63) Continuation of application No. 13/912,564, filed on Jun. 7, 2013, now Pat. No. 8,920,874, which is a (Continued)

(30) Foreign Application Priority Data

Jan. 15, 2010 (SE) ..... 1050037-9

(51) Int. Cl.
*E04F 15/10* (2006.01)
*B44C 5/04* (2006.01)
(Continued)

(52) U.S. Cl.
CPC ..... *E04F 15/10* (2013.01); *B05D 3/02* (2013.01); *B05D 3/12* (2013.01); *B44C 5/043* (2013.01);
(Continued)

(58) Field of Classification Search
CPC ..... B32B 2471/00; B32B 21/02; B32B 2262/067; B32B 2264/067;
(Continued)

(56) References Cited

U.S. PATENT DOCUMENTS 2,231,953 A 2/1941 Ruzicka
2,587,064 A 2/1952 Rapson
(Continued)

FOREIGN PATENT DOCUMENTS

AU 80284/75 6/1975
CA 2 557 096 A1 7/2005
(Continued)

OTHER PUBLICATIONS

Engstrand, Ola. "IPCOM000176590D." IP.com Journal (2008): n. pag. IP.com. Nov. 17, 2008. Web. <https://ip.com/IPCOM/000176590>. (Year: 2008).*
(Continued)

*Primary Examiner* — Larissa Rowe Emrich
(74) *Attorney, Agent, or Firm* — Buchanan Ingersoll & Rooney P.C.

(57) ABSTRACT

A building panel including a carrier, and a surface layer arranged on the carrier, wherein the surface layer includes a mix of refined fibres and a resin, wherein the weight ratio of resin to refined fibres is higher than about 120%, wherein the surface layer is applied as a dry powder layer.

13 Claims, 1 Drawing Sheet

Related U.S. Application Data continuation of application No. 12/976,329, filed on Dec. 22, 2010, now Pat. No. 8,481,111.

(60) Provisional application No. 61/295,343, filed on Jan. 15, 2010.

(51) Int. Cl.

| | |
|---|---|
| ***E04F 15/02*** | (2006.01) |
| ***E04B 1/62*** | (2006.01) |
| ***B05D 3/02*** | (2006.01) |
| ***B05D 3/12*** | (2006.01) |

(52) U.S. Cl.

CPC ..... *E04B 1/62* (2013.01); *E04F 15/02* (2013.01); *Y10T 428/265* (2015.01); *Y10T 428/31982* (2015.04); *Y10T 428/31989* (2015.04)

(58) Field of Classification Search

CPC ... B32B 2317/16; B32B 21/042; B32B 21/08; B32B 21/10; B32B 27/00–06; B32B 27/18–20; B32B 27/28; B32B 33/00; B32B 21/04; B05D 3/12; B05D 3/02; B44C 5/043; Y10T 428/31982; Y10T 428/31989; Y10T 428/265; E04B 1/62; E04F 15/02; E04F 15/10–107; E04F 15/02172

USPC ..... 428/292.4

See application file for complete search history.

(56) References Cited

U.S. PATENT DOCUMENTS

| | | | |
|---|---|---|---|
| 2,831,793 | A | 4/1958 | Elmendorf |
| 2,962,081 | A | 11/1960 | Dobry et al. |
| 3,032,820 | A | 5/1962 | Johnson |
| 3,135,643 | A | 6/1964 | Michl |
| 3,164,648 | A | 1/1965 | Franksson |
| 3,286,006 | A | 11/1966 | Annand |
| 3,308,013 | A | 3/1967 | Bryant |
| 3,325,302 | A | 6/1967 | Hosfeld |
| 3,342,621 | A | 9/1967 | Point et al. |
| 3,345,234 | A | 10/1967 | Jecker et al. |
| 3,373,070 | A | 3/1968 | Fuerst |
| 3,426,730 | A | 2/1969 | Lawson et al. |
| 3,463,653 | A | 8/1969 | Letter |
| 3,486,484 | A | 12/1969 | Bullough |
| 3,533,725 | A | 10/1970 | Bridgeford |
| 3,540,978 | A | 11/1970 | Ames |
| 3,565,665 | A | 2/1971 | Stranch et al. |
| 3,647,500 | A | 3/1972 | Mizuno |
| 3,673,020 | A | 6/1972 | De Jaeger |
| 3,674,619 | A | 7/1972 | Scher |
| 3,793,125 | A | 2/1974 | Kunz |
| 3,846,219 | A | 11/1974 | Kunz |
| 3,880,687 | A | 4/1975 | Elmendorf et al. |
| 3,897,185 | A | 7/1975 | Beyer |
| 3,897,588 | A | 7/1975 | Nohtomi |
| 3,914,359 | A | 10/1975 | Bevan |
| 3,931,428 | A | 1/1976 | Reick |
| 3,961,108 | A | 6/1976 | Rosner et al. |
| 3,975,483 | A | 8/1976 | Rudloff |
| 4,035,215 | A | 7/1977 | Goldstone |
| 4,052,739 | A | 10/1977 | Wada et al. |
| 4,093,766 | A | 6/1978 | Scher et al. |
| 4,131,705 | A | 12/1978 | Kubinsky |
| 4,255,480 | A | 3/1981 | Scher |
| 4,313,857 | A | 2/1982 | Blount |
| 4,337,290 | A | 6/1982 | Kelly et al. |
| 4,400,705 | A | 8/1983 | Horike |
| 4,420,525 | A | 12/1983 | Parks |
| 4,430,375 | A | 2/1984 | Scher et al. |
| 4,474,920 | A | 10/1984 | Kyminas et al. |
| 4,890,656 | A | 1/1990 | Ohsumi et al. |
| 5,034,272 | A | 7/1991 | Lindgren et al. |
| 5,134,026 | A | 7/1992 | Melcher |
| 5,206,066 | A | 4/1993 | Horacek |
| 5,246,765 | A | 9/1993 | Lussi et al. |
| 5,258,216 | A | 11/1993 | Von Bonin et al. |
| 5,266,384 | A | 11/1993 | O'Dell |
| 5,314,554 | A | 5/1994 | Owens |
| 5,405,681 | A | 4/1995 | Nakayama et al. |
| 5,405,705 | A | 4/1995 | Fujimoto et al. |
| 5,422,170 | A * | 6/1995 | Iwata ..... B27N 3/005 428/218 |
| 5,466,511 | A | 11/1995 | O'Dell et al. |
| 5,543,193 | A | 8/1996 | Tesch |
| 5,569,424 | A | 10/1996 | Amour |
| 5,601,930 | A | 2/1997 | Mehta et al. |
| 5,604,025 | A | 2/1997 | Tesch |
| 5,609,966 | A | 3/1997 | Perrin et al. |
| 5,670,237 | A | 9/1997 | Shultz et al. |
| 5,766,522 | A | 6/1998 | Daly et al. |
| 5,827,788 | A | 10/1998 | Miyakoshi |
| 5,855,832 | A | 1/1999 | Clausi |
| 5,865,003 | A | 2/1999 | Klett |
| 5,891,564 | A | 4/1999 | Schultz et al. |
| 5,925,296 | A | 7/1999 | Leese |
| 5,942,072 | A | 8/1999 | McKinnon |
| 6,036,137 | A | 3/2000 | Myren |
| 6,103,377 | A | 8/2000 | Clausi |
| 6,238,750 | B1 | 5/2001 | Correll et al. |
| 6,324,809 | B1 | 12/2001 | Nelson |
| 6,403,857 | B1 | 6/2002 | Gross et al. |
| 6,468,645 | B1 | 10/2002 | Clausi |
| 6,521,326 | B1 | 2/2003 | Fischer et al. |
| 6,537,610 | B1 | 3/2003 | Springer et al. |
| 6,617,009 | B1 | 9/2003 | Chen |
| 6,620,349 | B1 | 9/2003 | Lopez |
| 6,652,695 | B1 | 11/2003 | Von Der Heide et al. |
| 6,666,951 | B1 | 12/2003 | Kostiw |
| 6,769,217 | B2 | 8/2004 | Nelson |
| 6,773,799 | B1 | 8/2004 | Persson et al. |
| 6,803,110 | B2 | 10/2004 | Drees et al. |
| 6,926,954 | B2 | 8/2005 | Shuren et al. |
| 6,991,830 | B1 | 1/2006 | Hansson et al. |
| 7,022,756 | B2 | 4/2006 | Singer |
| 7,485,693 | B2 | 2/2009 | Matsuda et al. |
| 7,811,489 | B2 | 10/2010 | Pervan |
| 8,349,234 | B2 | 1/2013 | Ziegler et al. |
| 8,349,235 | B2 | 1/2013 | Pervan et al. |
| 8,419,877 | B2 | 4/2013 | Pervan et al. |
| 8,431,054 | B2 | 4/2013 | Pervan et al. |
| 8,480,841 | B2 | 7/2013 | Pervan et al. |
| 8,481,111 | B2 | 7/2013 | Ziegler et al. |
| 8,617,439 | B2 | 12/2013 | Pervan et al. |
| 8,663,785 | B2 | 3/2014 | Ziegler et al. |
| 8,728,564 | B2 | 5/2014 | Ziegler et al. |
| 8,784,587 | B2 | 7/2014 | Lindgren et al. |
| 8,920,874 | B2 | 12/2014 | Ziegler et al. |
| 8,920,876 | B2 | 12/2014 | Vetter et al. |
| 8,973,270 | B2 | 3/2015 | Siebert et al. |
| 8,993,049 | B2 | 3/2015 | Pervan |
| 9,085,905 | B2 | 7/2015 | Persson et al. |
| 9,181,698 | B2 | 11/2015 | Pervan et al. |
| 9,255,405 | B2 | 2/2016 | Pervan et al. |
| 9,296,191 | B2 | 3/2016 | Pervan et al. |
| 9,352,499 | B2 | 5/2016 | Ziegler et al. |
| 9,403,286 | B2 | 8/2016 | Vetter et al. |
| 9,410,319 | B2 | 8/2016 | Ziegler et al. |
| 9,556,622 | B2 | 1/2017 | Pervan et al. |
| 9,573,343 | B2 | 2/2017 | Pervan |
| 9,738,095 | B2 | 8/2017 | Pervan |
| 9,757,928 | B2 | 9/2017 | Pervan et al. |
| 9,783,996 | B2 | 10/2017 | Pervan et al. |
| 10,017,950 | B2 | 7/2018 | Pervan |
| 10,100,535 | B2 | 10/2018 | Pervan et al. |
| 10,214,913 | B2 | 2/2019 | Persson et al. |
| 10,286,633 | B2 | 5/2019 | Lundblad et al. |
| 10,307,984 | B2 | 6/2019 | Pervan |
| 10,315,219 | B2 | 6/2019 | Jacobsson |
| 10,344,379 | B2 | 7/2019 | Pervan et al. |

(56) References Cited

U.S. PATENT DOCUMENTS 10,364,578 B2 7/2019 Pervan
10,392,812 B2 8/2019 Pervan
10,442,152 B2 10/2019 Schulte
10,442,164 B2 10/2019 Schulte
10,493,729 B2 12/2019 Pervan et al.
10,513,094 B2 12/2019 Persson et al.
10,800,186 B2 10/2020 Pervan et al.
10,828,881 B2 11/2020 Bergelin et al.
10,857,765 B2 12/2020 Schulte
10,899,166 B2 1/2021 Pervan et al.
10,913,176 B2 2/2021 Lindgren et al.
10,926,509 B2 2/2021 Schulte
10,967,608 B2 4/2021 Pervan
10,981,362 B2 4/2021 Ziegler et al.
10,988,941 B2 4/2021 Ziegler et al.
11,040,371 B2 6/2021 Jacobsson
11,046,063 B2 6/2021 Persson et al.
11,072,156 B2 7/2021 Schulte
11,090,972 B2 8/2021 Persson et al.
11,135,814 B2 10/2021 Pervan et al.
11,167,533 B2 11/2021 Ziegler et al.
11,235,565 B2 2/2022 Pervan et al.
11,313,123 B2 4/2022 Pervan et al.
11,318,726 B2 5/2022 Pervan et al.
2001/0006704 A1 7/2001 Chen et al.
2001/0009309 A1 7/2001 Taguchi et al.
2002/0054994 A1 5/2002 Dupre et al.
2002/0100231 A1 8/2002 Miller
2002/0155297 A1 10/2002 Shuren
2003/0021915 A1 1/2003 Rohatgi et al.
2003/0056873 A1 3/2003 Nakos et al.
2003/0059639 A1 3/2003 Worsley
2003/0102094 A1 6/2003 Tirri et al.
2003/0119987 A1 6/2003 Eadara et al.
2003/0129361 A1 7/2003 Plug
2003/0208980 A1 11/2003 Miller et al.
2003/0233809 A1 12/2003 Pervan
2004/0086678 A1 5/2004 Chen et al.
2004/0123542 A1 7/2004 Grafenauer
2004/0169710 A1 9/2004 Ide
2004/0191547 A1 9/2004 Oldorff
2004/0202857 A1 10/2004 Singer
2004/0206036 A1 10/2004 Pervan
2004/0237436 A1 12/2004 Zuber et al.
2004/0247831 A1 12/2004 Nakagawa
2004/0250911 A1 12/2004 Vogel
2005/0003099 A1 1/2005 Quist
2005/0079780 A1* 4/2005 Rowe ..... B32B 5/24 442/33
2005/0093194 A1 5/2005 Oriakhi
2005/0193677 A1 9/2005 Vogel
2005/0249929 A1 11/2005 Reichwein et al.
2005/0250879 A1 11/2005 Correll et al.
2005/0252130 A1 11/2005 Martensson
2006/0005498 A1 1/2006 Sabater et al.
2006/0008630 A1 1/2006 Thiers et al.
2006/0021165 A1* 2/2006 Boland ..... A61C 17/3436 15/22.1
2006/0024465 A1* 2/2006 Briere ..... B32B 3/04 428/60
2006/0032175 A1 2/2006 Chen et al.
2006/0048474 A1 3/2006 Pervan et al.
2006/0070321 A1 4/2006 Au
2006/0142433 A1 6/2006 Rivers
2006/0145384 A1 7/2006 Singer
2006/0156672 A1 7/2006 Laurent et al.
2006/0182938 A1 8/2006 Oldorff
2006/0183853 A1 8/2006 Sczepan
2007/0055012 A1 3/2007 Caldwell
2007/0066176 A1 3/2007 Wenstrup et al.
2007/0159814 A1 7/2007 Jacobsson
2007/0166516 A1 7/2007 Kim et al.
2007/0184244 A1 8/2007 Doehring
2007/0207296 A1 9/2007 Eisermann
2007/0218260 A1 9/2007 Miclo et al.
2007/0224438 A1 9/2007 Van Benthem et al.
2007/0243359 A1 10/2007 Petersen
2007/0256804 A1* 11/2007 Garcis Espino ..... B27N 1/00 162/162
2007/0295446 A1 12/2007 Behr et al.
2008/0000417 A1 1/2008 Pervan et al.
2008/0032120 A1 2/2008 Braun
2008/0090032 A1 4/2008 Perrin et al.
2008/0176039 A1 7/2008 Chen et al.
2008/0263985 A1 10/2008 Hasch et al.
2009/0031662 A1 2/2009 Chen et al.
2009/0056257 A1 3/2009 Mollinger et al.
2009/0124704 A1 5/2009 Jenkins
2009/0135356 A1 5/2009 Ando
2009/0139170 A1 6/2009 Thiers
2009/0145066 A1 6/2009 Pervan
2009/0155612 A1 6/2009 Pervan et al.
2009/0208646 A1 8/2009 Kreuder et al.
2009/0294037 A1 12/2009 Oldorff
2009/0311433 A1 12/2009 Wittmann
2010/0066121 A1 3/2010 Gross
2010/0092731 A1 4/2010 Pervan et al.
2010/0196678 A1 8/2010 Vermeulen
2010/0223881 A1 9/2010 Kalwa
2010/0239820 A1 9/2010 Buhlmann
2010/0291397 A1 11/2010 Pervan et al.
2010/0300030 A1 12/2010 Pervan et al.
2010/0307675 A1 12/2010 Buhlmann
2010/0307677 A1 12/2010 Buhlmann
2010/0310893 A1* 12/2010 Derbyshire ..... B32B 21/02 428/528
2010/0319282 A1 12/2010 Ruland
2010/0323187 A1* 12/2010 Kalwa ..... B32B 33/00 428/325
2010/0330376 A1 12/2010 Trksak
2011/0175251 A1 7/2011 Ziegler et al.
2011/0177319 A1 7/2011 Ziegler et al.
2011/0177354 A1 7/2011 Ziegler et al.
2011/0189448 A1 8/2011 Lindgren et al.
2011/0189471 A1 8/2011 Ziegler
2011/0247748 A1 10/2011 Pervan et al.
2011/0250404 A1 10/2011 Pervan et al.
2011/0262720 A1 10/2011 Riebel et al.
2011/0283642 A1 11/2011 Meirlaen et al.
2011/0283650 A1 11/2011 Pervan et al.
2011/0293823 A1 12/2011 Bruderer et al.
2011/0293906 A1 12/2011 Jacobsson
2012/0263878 A1 10/2012 Ziegler et al.
2012/0263965 A1 10/2012 Persson et al.
2012/0264853 A1 10/2012 Ziegler et al.
2012/0288689 A1 11/2012 Hansson et al.
2012/0308774 A1 12/2012 Persson et al.
2013/0065072 A1 3/2013 Pervan
2013/0092314 A1 4/2013 Zeigler et al.
2013/0095315 A1 4/2013 Pervan et al.
2013/0111845 A1 5/2013 Pervan et al.
2013/0189534 A1 7/2013 Pervan et al.
2013/0269863 A1 10/2013 Pervan et al.
2013/0273244 A1 10/2013 Vetter et al.
2013/0273245 A1 10/2013 Ziegler et al.
2014/0017452 A1 1/2014 Pervan
2014/0044872 A1 2/2014 Pervan
2014/0075874 A1 3/2014 Pervan et al.
2014/0171554 A1 6/2014 Ziegler et al.
2014/0178630 A1 6/2014 Pervan et al.
2014/0186610 A1 7/2014 Pervan
2014/0199513 A1 7/2014 Pervan et al.
2014/0199558 A1 7/2014 Pervan et al.
2014/0234531 A1 8/2014 Ziegler et al.
2014/0255670 A1 9/2014 Kalwa
2015/0017461 A1 1/2015 Lindgren et al.
2015/0079280 A1 3/2015 Vetter et al.
2015/0111055 A1 4/2015 Persson et al.
2015/0159382 A1 6/2015 Pervan
2015/0197942 A1 7/2015 Pervan et al.
2015/0197943 A1 7/2015 Ziegler et al.
2015/0275526 A1 10/2015 Persson et al.
2015/0298433 A1 10/2015 Kalwa
2015/0343739 A1 12/2015 Pervan

(56) References Cited

U.S. PATENT DOCUMENTS

| | | | |
|---|---|---|---|
| 2016/0031189 | A1 | 2/2016 | Pervan et al. |
| 2016/0114495 | A1 | 4/2016 | Pervan et al. |
| 2016/0186318 | A1 | 6/2016 | Pervan et al. |
| 2016/0230400 | A9 | 8/2016 | Pervan et al. |
| 2016/0303868 | A1 | 10/2016 | Hansson et al. |
| 2016/0368180 | A1 | 12/2016 | Ziegler et al. |
| 2016/0369507 | A1 | 12/2016 | Pervan |
| 2016/0375674 | A1 | 12/2016 | Schulte |
| 2017/0120558 | A1 | 5/2017 | Pervan |
| 2017/0120564 | A1 | 5/2017 | Schulte |
| 2017/0165936 | A1 | 6/2017 | Schulte |
| 2017/0190156 | A1 | 7/2017 | Ziegler et al. |
| 2017/0232761 | A1 | 8/2017 | Pervan et al. |
| 2017/0305119 | A1 | 10/2017 | Bergelin et al. |
| 2017/0348984 | A1 | 12/2017 | Pervan et al. |
| 2018/0002934 | A1 | 1/2018 | Pervan et al. |
| 2018/0291638 | A1 | 10/2018 | Pervan |
| 2018/0370278 | A1 | 12/2018 | Persson et al. |
| 2019/0010711 | A1 | 1/2019 | Pervan et al. |
| 2019/0202178 | A1 | 7/2019 | Ziegler |
| 2019/0210329 | A1 | 7/2019 | Ziegler et al. |
| 2019/0210330 | A1 | 7/2019 | Ziegler et al. |
| 2019/0248108 | A1 | 8/2019 | Pervan |
| 2019/0277039 | A1 | 9/2019 | Persson et al. |
| 2019/0284821 | A1 | 9/2019 | Pervan |
| 2019/0292796 | A1 | 9/2019 | Pervan et al. |
| 2019/0338534 | A1 | 11/2019 | Pervan |
| 2020/0055287 | A1 | 2/2020 | Lundblad et al. |
| 2020/0078825 | A1 | 3/2020 | Jacobsson |
| 2020/0079059 | A1 | 3/2020 | Schulte |
| 2020/0094512 | A1 | 3/2020 | Schulte |
| 2020/0164622 | A1 | 5/2020 | Pervan et al. |
| 2020/0215799 | A1 | 7/2020 | Hedlund et al. |
| 2020/0223197 | A1 | 7/2020 | Hedlund et al. |
| 2021/0001647 | A1 | 1/2021 | Pervan et al. |
| 2021/0008863 | A1 | 1/2021 | Bergelin et al. |
| 2021/0078305 | A1 | 3/2021 | Schulte |
| 2021/0101310 | A1 | 4/2021 | Lindgren et al. |
| 2021/0129485 | A1 | 5/2021 | Pervan |
| 2021/0197534 | A1 | 7/2021 | Ziegler et al. |
| 2021/0277670 | A1 | 9/2021 | Ziegler et al. |
| 2021/0323297 | A1 | 10/2021 | Slottemo et al. |
| 2022/0009248 | A1 | 1/2022 | Ryberg et al. |
| 2022/0024189 | A1 | 1/2022 | Ziegler et al. |
| 2022/0024195 | A1 | 1/2022 | Schulte |
| 2022/0063326 | A1 | 3/2022 | Persson et al. |

FOREIGN PATENT DOCUMENTS

| | | | |
|---|---|---|---|
| CH | 298894 | A | 5/1954 |
| DE | 1 815 312 | A1 | 7/1969 |
| DE | 7148789 | U | 4/1972 |
| DE | 29 39 828 | A1 | 4/1981 |
| DE | 33 34 921 | A1 | 4/1985 |
| DE | 42 36 266 | A1 | 5/1993 |
| DE | 101 56 956 | A1 | 6/2003 |
| DE | 202 14 532 | U1 | 2/2004 |
| DE | 103 31 657 | A1 | 2/2005 |
| DE | 20 2004 003 061 | U1 | 7/2005 |
| DE | 10 2004 050 278 | A1 | 4/2006 |
| DE | 20 2006 007 797 | U1 | 8/2006 |
| DE | 10 2005 046 264 | A1 | 4/2007 |
| DE | 10 2006 024 593 | A1 | 12/2007 |
| DE | 10 2007 046 532 | B3 | 10/2008 |
| EP | 0 129 430 | A2 | 12/1984 |
| EP | 0 129 430 | B1 | 1/1990 |
| EP | 0 355 829 | A2 | 2/1990 |
| EP | 0 611 408 | A1 | 12/1993 |
| EP | 0 592 013 | A2 | 4/1994 |
| EP | 0 656 443 | A1 | 6/1995 |
| EP | 0 611 408 | B1 | 9/1996 |
| EP | 0 732 449 | A1 | 9/1996 |
| EP | 0 744 477 | A2 | 11/1996 |
| EP | 0 914 914 | A2 | 5/1999 |
| EP | 0 732 449 | B1 | 8/1999 |
| EP | 0 744 477 | B1 | 1/2000 |
| EP | 1 035 255 | A1 | 9/2000 |
| EP | 1 125 971 | A1 | 8/2001 |
| EP | 1 136 251 | A2 | 9/2001 |
| EP | 1 193 288 | A1 | 4/2002 |
| EP | 1 209 199 | A1 | 5/2002 |
| EP | 1 242 702 | A1 | 9/2002 |
| EP | 1 249 322 | A1 | 10/2002 |
| EP | 1 454 763 | A2 | 9/2004 |
| EP | 1 242 702 | B1 | 11/2004 |
| EP | 1 498 241 | A2 | 1/2005 |
| EP | 1 507 664 | A1 | 2/2005 |
| EP | 1 507 664 | B1 | 2/2005 |
| EP | 1 584 378 | A1 | 10/2005 |
| EP | 1 681 103 | A2 | 7/2006 |
| EP | 1 690 603 | A1 | 8/2006 |
| EP | 1 749 676 | A1 | 2/2007 |
| EP | 1 847 385 | A1 | 10/2007 |
| EP | 1 961 556 | A1 | 8/2008 |
| EP | 1 985 464 | A1 | 10/2008 |
| EP | 1 997 623 | A1 | 12/2008 |
| EP | 2 025 484 | A1 | 2/2009 |
| EP | 1 454 763 | B1 | 8/2009 |
| EP | 2 105 320 | A1 | 9/2009 |
| EP | 2 106 903 | A1 | 10/2009 |
| EP | 2 213 476 | A1 | 8/2010 |
| EP | 2 226 201 | A1 | 9/2010 |
| EP | 2 246 500 | A2 | 11/2010 |
| EP | 2 264 259 | A2 | 12/2010 |
| FR | 2 873 953 | A1 | 2/2006 |
| GB | 984 170 | A | 2/1965 |
| GB | 1090450 | | 11/1967 |
| GB | 2 248 246 | A | 4/1992 |
| JP | 2-229002 | A | 9/1990 |
| JP | H05-162230 | A | 6/1993 |
| JP | 11-291203 | A | 10/1999 |
| JP | 2001-287208 | A | 10/2001 |
| JP | 2002-001748 | A | 1/2002 |
| JP | 2003-311717 | A | 11/2003 |
| JP | 2003-311718 | A | 11/2003 |
| JP | 2005-034815 | A | 2/2005 |
| JP | 2005-074682 | A | 3/2005 |
| JP | 2005-170016 | A | 6/2005 |
| JP | 2005-219215 | A | 8/2005 |
| JP | 3705482 | B2 | 10/2005 |
| JP | 2005-307582 | A | 11/2005 |
| JP | 2007-216692 | A | 8/2007 |
| JP | 2007-268843 | A | 10/2007 |
| JP | 2008-188826 | A | 8/2008 |
| NZ | 225556 | A1 | 2/1992 |
| SE | 469 326 | B | 6/1993 |
| WO | WO 89/03753 | A1 | 5/1989 |
| WO | WO 92/06832 | A1 | 4/1992 |
| WO | WO 93/24295 | A1 | 12/1993 |
| WO | WO 93/24296 | A1 | 12/1993 |
| WO | WO 94/00280 | A1 | 1/1994 |
| WO | WO 95/06568 | A1 | 3/1995 |
| WO | WO 00/22225 | A1 | 4/2000 |
| WO | WO 00/44576 | A1 | 8/2000 |
| WO | WO 00/53380 | A1 | 9/2000 |
| WO | WO 01/00409 | A1 | 1/2001 |
| WO | WO 01/48333 | A1 | 7/2001 |
| WO | WO 01/64408 | A1 | 9/2001 |
| WO | WO 01/68367 | A1 | 9/2001 |
| WO | WO 01/74605 | A2 | 10/2001 |
| WO | WO 01/74605 | A3 | 10/2001 |
| WO | WO 01/92037 | A2 | 12/2001 |
| WO | WO 02/42167 | A2 | 5/2002 |
| WO | WO 02/42373 | A1 | 5/2002 |
| WO | WO 03/078761 | A1 | 9/2003 |
| WO | WO 03/095202 | A1 | 11/2003 |
| WO | WO 2004/042168 | A1 | 5/2004 |
| WO | WO 2004/050359 | A1 | 6/2004 |
| WO | WO 2004/067874 | A2 | 8/2004 |
| WO | WO 2005/010296 | A1 | 2/2005 |
| WO | WO 2005/054600 | A1 | 6/2005 |
| WO | WO 2005/066431 | A2 | 7/2005 |
| WO | WO 2005/080096 | A2 | 9/2005 |
| WO | WO 2005/097874 | A2 | 10/2005 |

(56) References Cited

FOREIGN PATENT DOCUMENTS

| | | | | |
|---|---|---|---|---|
| WO | WO 2005/116337 | A1 | 12/2005 | |
| WO | WO 2005/116361 | A1 | 12/2005 | |
| WO | WO 2006/002733 | A1 | 1/2006 | |
| WO | WO 2006/007413 | A1 | 1/2006 | |
| WO | WO 2006/013469 | A1 | 2/2006 | |
| WO | WO 2006/015313 | A2 | 2/2006 | |
| WO | WO 2006/042651 | A1 | 4/2006 | |
| WO | WO 2006/043893 | A1 | 4/2006 | |
| WO | WO 2006/066776 | A2 | 6/2006 | |
| WO | WO 2006/126930 | A1 | 11/2006 | |
| WO | WO 2007/015669 | A2 | 2/2007 | |
| WO | WO 2007/015669 | A3 | 2/2007 | |
| WO | WO 2007/042258 | A1 | 4/2007 | |
| WO | WO 2007/059294 | A2 | 5/2007 | |
| WO | WO 2008/004960 | A2 | 1/2008 | |
| WO | WO 2008/004960 | A3 | 1/2008 | |
| WO | WO 2008/004960 | A8 | 1/2008 | |
| WO | WO 2008/057390 | A2 | 5/2008 | |
| WO | WO 2008/057390 | A3 | 5/2008 | |
| WO | WO 2008057390 | A2 * | 5/2008 | ..... B32B 21/02 |
| WO | WO 2008/148771 | A1 | 12/2008 | |
| WO | WO 2009/065768 | A1 | 5/2009 | |
| WO | WO 2009/065769 | A2 | 5/2009 | |
| WO | WO 2009/065769 | A3 | 5/2009 | |
| WO | WO 2009/080772 | A1 | 7/2009 | |
| WO | WO 2009/080813 | A1 | 7/2009 | |
| WO | WO 2009/116926 | A1 | 9/2009 | |
| WO | WO 2009/124704 | A1 | 10/2009 | |
| WO | WO 2009/135323 | A1 | 11/2009 | |
| WO | WO 2010/084466 | A2 | 7/2010 | |
| WO | WO 2010/087752 | A1 | 8/2010 | |
| WO | WO 2010/094500 | A1 | 8/2010 | |
| WO | WO 2011/087422 | A1 | 7/2011 | |
| WO | WO 2011/087423 | A1 | 7/2011 | |
| WO | WO 2011/129757 | A1 | 10/2011 | |
| WO | WO 2011/141851 | A2 | 11/2011 | |
| WO | WO 2012/004699 | A2 | 1/2012 | |
| WO | WO 2012/018934 | A1 | 2/2012 | |
| WO | WO 2012/037950 | A1 | 3/2012 | |

OTHER PUBLICATIONS

Mortensen, A.. (2007). Concise Encyclopedia of Composite Materials (2nd Edition)—Wood-Plastic Composites. pp. 932-936 Elsevier. Retrieved from https://app.knovel.com/hotlink/pdf/id:kt00U06FO1/concise-encyclopedia/wood-plastic-composites (Year: 2007).*

U.S. Appl. No. 12/270,257 Darko Pervan, Kent Lindgren, Jan Jacobsson, Niclas Håkansson, Eddy Boucké and Göran Ziegler, filed Nov. 13, 2008 (cited herein as US Patent Application Publication No. 2009/0155612 A1 of Jun. 18, 2009).

U.S. Appl. No. 14/789,339, Kalwa.

"Hex Netting—Fencing—Ace Hardware," from http://www.acehardware.com/family/index.jsp?categoryId=1260278, archived on Nov. 1, 2009, accessed through the Internet Archive, WaybackMachine, 3 pages.

Kalwa, Norbert, U.S. Appl. No. 14/789,339 entitled "Panel, Use of a Panel, Method for Manufacturing a Panel and a Prepreg," filed Jul. 1, 2015.

U.S. Appl. No. 14/980,638, Pervan et al.

U.S. Appl. No. 15/061,303, Pervan et al.

Pervan, Darko, et al., U.S. Appl. No. 14/980,638 entitled "Wood Fibre Based Panels with a Thin Surface Layer," filed Dec. 28, 2015.

Pervan, Darko, et al., U.S. Appl. No. 15/061,303 entitled "Powder Overlay," filed Mar. 4, 2016.

U.S. Appl. No. 15/162,868 Göran Ziegler, Marcus Bergelin, Jan Jacobsson and Melker Ryberg, filed May 24, 2016.

U.S. Appl. No. 15/204,474 Georg Vetter, Jan Jacobsson, Rickard Rittinge and Hans Persson, filed Jul. 7, 2016.

U.S. Appl. No. 15/162,868, filed Ziegler et al.

U.S. Appl. No. 15/204,474, filed Vetter et al.

Ziegler, Göran, et al., U.S. Appl. No. 15/162,868 entitled "Method of Manufacturing a Layer," filed May 24, 2016.

Vetter, Georg, et al., U.S. Appl. No. 15/204,474 entitled "Method for Producing a Building Panel," filed Jul. 7, 2016.

U.S. Appl. No. 12/815,757 Norbert Kalwa, filed Jun. 15, 2010 (cited herein a US Patent Application Publication No. 2010/0323187 A1 of Dec. 23, 2010).

U.S. Appl. No. 13/084,974 Darko Pervan, filed Apr. 12, 2011 (cited herein as US Patent Application Publication No. 2011/0250404 A1 of Oct. 13, 2011).

U.S. Appl. No. 13/118,846 Jan Jacobsson, filed May 31, 2011 (cited herein as US Patent Application Publication No. 2011/0293906 A1 of Dec. 1, 2011).

U.S. Appl. No. 13/444,653 Hans Persson, Niclas Håkansson and Jan Jacobsson, filed Apr. 11, 2012 (cited herein as US Patent Application Publication No. 2012/0263965 A1 of Oct. 18, 2012).

U.S. Appl. No. 13/445,379 Göran Ziegler, Marcus Bergelin, Jan Jacobsson and Melker Ryberg, filed Apr. 12, 2012 (cited herein as US Patent Application Publication No. 2012/0264853 A1 of Oct. 18, 2012).

U.S. Appl. No. 13/793,971 Darko Pervan, Jan Jacobsson, Kent Lindgren, Göran Ziegler, Niclas Håkansson and Eddy Boucké, filed Mar. 11, 2013 (cited herein as US Patent Application Publication No. 2013/0189534 A1 of Jul. 25, 2013).

U.S. Appl. No. 13/912,587 Darko Pervan and Göran Ziegler, filed Jun. 7, 2013 (cited herein as US Patent Application Publication No. 2013/0269863 A1 of Oct. 17, 2013).

U.S. Appl. No. 14/089,928 Darko Pervan, Kent Lindgren, Jan Jacobsson, Niclas Håkansson, Eddy Boucké and Göran Ziegler, filed Nov. 26, 2013 (cited herein as US Patent Application Publication No. 2014/0075874 A1 of Mar. 20, 2014).

U.S. Appl. No. 14/151,973 Darko Pervan, Niclas Håkansson and Hans Persson, filed Jan. 10, 2014 (cited herein as US Patent Application Publication No. 2014/0199558 A1 of Jul. 17, 2014).

U.S. Appl. No. 14/192,169 Darko Pervan, Kent Lindgren, Jan Jacobsson, Niclas Håkansson, Eddy Boucké and Göran Ziegler, filed Feb. 27, 2014 (Cited herein as US Patent Application Publication No. 2014/0178630 A1 of Jun. 26, 2014).

U.S. Appl. No. 14/237,617 Darko Pervan, filed Feb. 7, 2014 (cited herein as US Patent Application Publication No. 2014/0186610 A1 of Jul. 3, 2014).

U.S. Appl. No. 14/184,299 Göran Ziegler and Kent Lindgren, filed Feb. 19, 2014 (cited herein as US Patent Application Publication No. 2014/0171554 A1 of Jun. 19, 2014).

U.S. Appl. No. 14/192,169 Darko Pervan, Kent Lindgren, Jan Jacobsson, Eddy Boucké, Göran Ziegler, Niclas Håkansson, filed Feb. 27, 2014 (cited herein as US Patent Application Publication No. 2014/0178630 A1 of Jun. 26, 2014).

U.S. Appl. No. 14/247,839 Göran Ziegler, Hans Persson and Rickard Rittinge, filed Apr. 8, 2014 (cited herein as US Patent Application Publication No. 2014/0234531 A1 of Aug. 21, 2014).

U.S. Appl. No. 14/321,288 Kent Lindgren, Hans Persson and Göran Ziegler, filed Jul. 1, 2014 (cited herein as US Patent Application Publication No. 2015/0017461 A1 of Jan. 15, 2015).

U.S. Appl. No. 14/553,196 Georg Vetter, Jan Jacobsson, Rickard Rittinge and Hans Persson, filed Nov. 25, 2014 (cited herein as US Patent Application Publication No. 2015/0079280 A1 of Mar. 19, 2015).

Parquet International, "Digital Printing is still an expensive process," Mar. 2008, cover page/pp. 78-79, www.parkettmagazin.com.

Floor Daily, "Shaw Laminates: Green by Design," Aug. 13, 2007, 1 pg, Dalton, GA.

BTLSR Toledo, Inc. website, http://www.bltresins.com/more.html. "Advantages to Using Powdered Resins," May 26, 2007, 2 pages, per the Internet Archive WayBackMachine.

Nimz, H.H., "Wood," Ullmann's Encyclopedia of Industrial Chemistry, published online Jun. 15, 2000, pp. 453-505, vol. 39, Wiley-VCH Verlag GmbH & Co. KgaA, Weinheim, DE.

International Search Report issued in corresponding PCT/SE2010/051472, dated Apr. 11, 2011, Swedish Patent Office, Stockholm, SE, 6 pages.

Extended European Search Report issued in EP10843341.8, dated Aug. 5, 2013, European Patent Office, Rijswijk, NL, 5 pages.

(56) References Cited

OTHER PUBLICATIONS

Engstrand, Ola (Contact)/Valinge Innovation, Technical Disclosure entitled "Fibre Based Panels With a Wear Resistance Surface," Nov. 17, 2008, IP.com No. IPCOM000176590D, IP.com PriorArtDatabase, 76 pages.
Engstrand, Ola (Contact)/Valinge Innovation, Technical Disclosure entitled "WFF Embossing," May 15, 2009, IP.com No. IPCOM000183105D, IP.com PriorArtDatabase, 36 pages.
Le Fur, X., et al., "Recycling melamine-impregnated paper waste as board adhesives," published online Oct. 26, 2004, pp. 419-423, vol. 62, Springer-Verlag, DE.
Odian, George, "Principles of Polymerization," 1991, 3rd Edition, 5 pages incl. pp. 122-123, John Wiley & Sons, Inc., New York, NY, USA.
U.S. Appl. No. 15/704,634, Darko Pervan, filed Sep. 14, 2017 (cited herein as US Patent Application No. 2018/0002934 A1 of Jan. 4, 2018).
Written Opinion (PCT/ISA/237) dated Dec. 11, 2012, by the Sweden Patent Office as the International Searching Authority for International Application No. PCT/SE2012/050896, 9 pages.
Engstrand, Ola (Contact)/Valinge Innovation, Technical Disclosure entitled "VA063 VA064 Scattering and Powder Backing," Nov. 11, 2011, IP.com No. IPCOM000212422D, IP.com PriorArtDatabase, 34 pages.
U.S. Appl. No. 16/416,846 Darko Pervan and Göran Ziegler, filed May 20, 2019.
U.S. Appl. No. 16/433,722 Darko Pervan, filed Jun. 6, 2019.
U.S. Appl. No. 16/439,037 Darko Pervan, Kent Lindgren, Jan Jacobsson, Eddy Boucké, Göran Ziegler and Niclas Håkansson, filed Jun. 12, 2019.
U.S. Appl. No. 16/416,846, Pervan et al.
U.S. Appl. No. 16/433,722, Pervan.
U.S. Appl. No. 16/439,037, Pervan et al.
BTLSR Toledo, Inc. website, http://www.btlresins.com/more.html. "Advantages to Using Powdered Resins," May 26, 2007, 2 pages, per the Internet Archive WayBackMachine.
Pervan, Darko, et al., U.S. Appl. No. 16/416,846 entitled "Powder Overlay," filed May 20, 2019.
Pervan, Darko, U.S. Appl. No. 16/433,722 entitled "Panel Coating," filed Jun. 6, 2019.
Pervan, Darko, et al., U.S. Appl. No. 16/439,037 entitled "Fibre Based Panels with a Wear Resistance Surface," filed Jun. 12, 2019.
U.S. Appl. No. 16/738,468, Anette Hedlund and Sofia Nilsson, filed Jan. 9, 2020 (Cited herein as US Patent Application Publication No. 2020/0223197 A1 of Jul. 16, 2020).
Abdullah, E.C., et al., "Cohesiveness and Flowability Properties of Silica Gel Powder," *Physics International*, 2010, pp. 16-21, 1 (1), ISSN 1948-9803, Science Publications.
U.S. Appl. No. 17/125,199 Kent Lindgren, Hans Persson and Göran Ziegler, filed Dec. 17, 2020.
U.S. Appl. No. 17/125,199, Lindgren et al.
Patt, Rudolf, "Paper and Pulp," in *Ullmann's Encyclopedia of Industrial Chemistry*, published online 2000, 157 pages, Wiley-VCH Verlag GmbH & Co., KGaA, Weinheim, DE.
Lindgren, Kent, et al., U.S. Appl. No. 17/125,199 entitled "Method of Manufacturing a Building Panel and a Building Panel," filed Dec. 17, 2020.

* cited by examiner

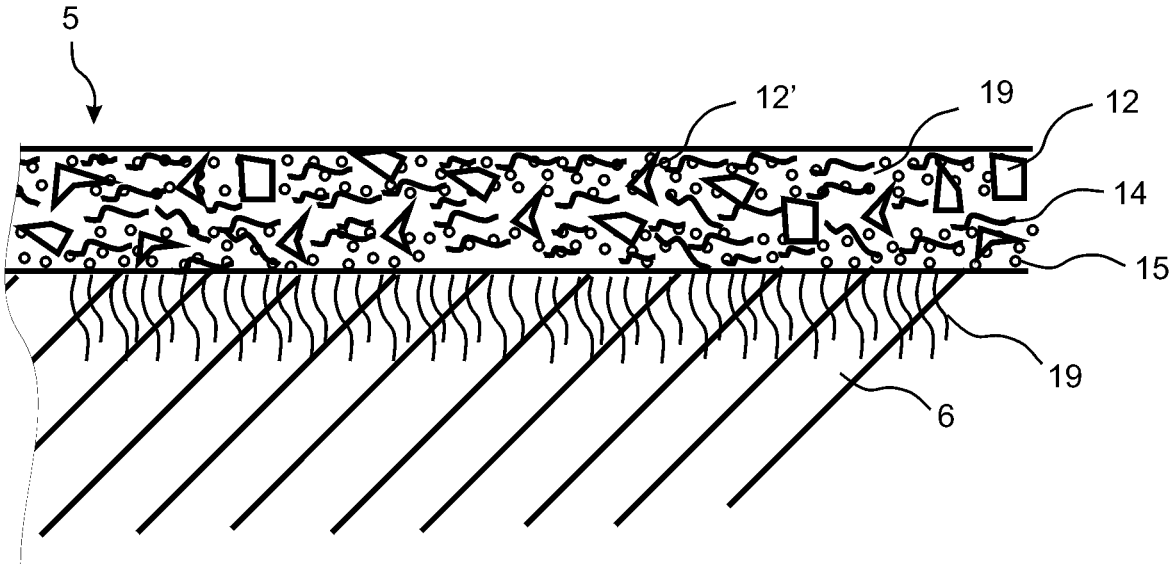
5
12'
19
12
14
15
19
6

BRIGHT COLOURED SURFACE LAYER

CROSS REFERENCE TO RELATED APPLICATIONS

The present application is a continuation of U.S. application Ser. No. 13/912,564, filed on Jun. 7, 2013, which is a continuation of U.S. application Ser. No. 12/976,329, filed on Dec. 22, 2010, which claims the benefit of U.S. Provisional Application No. 61/295,343, filed on Jan. 15, 2010, and claims the benefit of Swedish Application No. 1050037-9, filed on Jan. 15, 2010. The entire contents of each of U.S. application Ser. No. 13/912,564, application Ser. No. 12/976,329, U.S. Provisional Application No. 61/295,343 and Swedish Application No. 1050037-9 are hereby incorporated herein by reference.

TECHNICAL FIELD

The disclosure generally relates to the field of fibre-based panels with wear resistant surface layers for building panels, preferably floor panels. The disclosure relates to building panels with such wear resistance surface and to production methods to produce such panels.

FIELD OF APPLICATION

The present disclosure is particularly suitable for use in floating floors, which are formed of floor panels with a wood fibre core and a decorative wear resistant surface. The following description of technique, problems of known systems and objects and features of the invention will therefore, as a non-restrictive example, be aimed above all at this field of application and in particular at floorings which are similar to traditional floating wood fibre based laminate floorings. The disclosure does not exclude floors that are glued down to a sub floor.

It should be emphasized that embodiments of the disclosure can be used as a panel or as a surface layer, which is for example glued to a core. Embodiments of the disclosure can also be used in applications as for example wall panels, ceilings, and furniture components and similar. Embodiments could also be used in floorings with optional surface materials such as cork or wood, in order to improve wear and design properties.

BACKGROUND

It is well known to produce laminated building panels with a surface comprising laminated paper sheets.

A new type of panel called Wood Fibre Floor (WFF) is disclosed in WO 2009/065769 which shows both products and methods to produce such a product.

Direct pressed laminated building panels usually comprises a core of a 6-12 mm fibre board, a 0.2 mm thick upper decorative surface layer of laminate and a 0.1-0.2 mm thick lower balancing layer of laminate, plastic, paper or like material.

A laminated surface generally comprise two paper sheets, a 0.1 mm thick printed decorative paper and a transparent 0.05-0.1 mm thick overlay paper applied over the decorative paper and intended to protect the decorative paper from abrasion. The print on the decorative non-transparent paper is only some 0.01 mm thick. The transparent overlay, which is made of refined a-cellulose fibres, comprises small hard and transparent aluminium oxide particles. The refined fibres are rather long, about 2-5 mm and this gives the overlay paper the required strength. In order to obtain the transparency, all natural resins that are present in the virgin wood fibres, have been removed and the aluminium oxide particles are applied as a very thin layer over the decorative paper. The surface layer of a laminate floor is characterized in that the decorative and wear resistance properties are generally obtained with two separate layers one over the other.

The printed decorative paper and the overlay are impregnated with melamine resin and laminated to a wood fibre based core under heat and pressure.

The small aluminium oxide particles could have a size in the range of 20-100 microns. The particles could be incorporated in the surface layer in several ways. For example they could be incorporated in the pulp during the manufacturing of the overlay paper. They could also be sprinkled on the wet lacquer during impregnation procedure of the overlay or incorporated in the lacquer used for impregnation of the overlay.

The wear layer could also be produced without a cellulose overlay. In such a case melamine resin and aluminium oxide particles are applied as a lacquered layer directly on the decorative paper with similar methods as described above. Such a wear layer is generally referred to as liquid overlay.

With this production method a very wear resistance surface could be obtained and this type of surface is mainly used in laminate floorings but it could also be used in furniture components and similar applications. High quality laminate floorings have a wear resistance of 4000-6000 revolutions, which corresponds to the abrasion classes AC4 and AC5 measured with a Taber Abraser according to ISO-standard.

It is also known that the wear resistance of a lacquered wood surface could be improved considerably by incorporating aluminium oxide particles in the transparent lacquer covering the wood surface.

The most common core material used in laminate floorings is fibreboard with high density and good stability usually called HDF—High Density Fibreboard. Sometimes also MDF—Medium Density Fibreboard—is used as core. Other core materials such as particleboard are also used.

The WFF floor panels are "paper free" with a surface layer comprising a substantially homogenous mix of wood fibres, binders and wear resistant particles. The wear resistant particles are preferably aluminium oxide particles and the binders are preferably thermosetting resins such as melamine. The wear resistant particles are provided throughout the thickness of the surface layer from the top to the bottom and in contact with the core of the panel. Other suitable materials are for example silica or silicon carbide. In general, all these materials are preferably applied in dry form as a mixed powder on a HDF core and cured under heat and pressure to a 0.2-1.0 mm surface layer.

DEFINITION OF SOME TERMS

In the following text, the visible surface of the installed floor panel is called "front side", while the opposite side of the floor panel, facing the sub floor, is called "rear side". The sheet-shaped material that comprises the major part of a panel and provides the panel with the required stability is called "core". When the core is coated with a surface layer closest to the front side and preferably also a balancing layer closest to the rear side, it forms a semi-manufacture, which is called "floor board" or "floor element" in the case where the semi-manufacture, in a subsequent operation, is divided into a plurality of floor elements. When the floor elements are machined along their edges so as to obtain their final shape with the joint system, they are called "floor panels". By "surface layer" is meant all layers which give the panel its decorative properties and its wear resistance and which are applied to the core closest to the front side covering preferably the entire front side of the floorboard. By "decorative surface layer" is meant a layer, which is mainly intended to give the floor its decorative appearance. "Wear layer" relates to a layer, which is mainly adapted to improve the durability of the front side.

By "horizontal plane" is meant a plane, which extends parallel to the outer part of the surface layer. By "horizontally" is meant parallel to the horizontal plane and by "vertically" is meant perpendicularly to the horizontal plane. By "up" is meant towards the front side and by "down" towards the rear side.

SUMMARY OF THE INVENTION

An overall objective of embodiments of the disclosure is to provide a building panel, preferably a floor panel with a pale and/or plain colour, e.g. bright white, wear resistant layer that could be produced in a more cost effective way than with the present known technology.

The methods described in WO 2009/065769 include the use of virgin or recycled wood fibres that have the limitation that while using pigments intended to give pale colours, e.g. bright white colour, or very intense colours, the natural colour of the virgin or recycled wood fibre give a less pale or less colourful result due to the natural resins of the fibres. The natural resin makes it difficult to achieve the desired colour and might cause areas that are discoloured. The problems of limited colourfulness could be solved by increasing the amount of the pigments, but this is a rather expensive solution and high pigment loadings could cause other problems such a pigment bleed.

Conventional laminated floors panels have a limitation in making pale coloured or intensively coloured surfaces, due to the limited transparency of the highly wear resistant overlays.

A solution to the problems is to use a dry powder layer comprising a mix of refined fibres binder, pigment and wear resistant particles.

An aspect of the invention is a production method to produce a pale coloured wear resistant surface layer comprising the steps of:

- applying a dry powder layer comprising a mix of refined fibres, binder, pigment and wear resistant particles on a carrier; and
- curing the mix to a colourful or bright white wear resistant layer by applying heat and pressure on the mix.

The binder is preferably a melamine resin and the wear resistant particles aluminium oxide. The pigments for making bright white products are preferably titanium dioxide, lead oxide or other commonly used pigments. The pigments for making very colourful products are a broad variety of both inorganic and organic origin.

The carrier on which the mix is applied is preferably an HDF panel and the resulting panel thereby has wear resistant particles throughout the thickness of the surface layer from the top to the bottom and in contact with the core of the panel.

The refined fibres are fibres that are predominantly free from the natural resins typically found in wood fibres or other natural fibres. Such fibres can be achieved through washing, extraction, bleaching or combinations thereof. An example of such a fibre is Technocel® 150 TAB which can be provided by the company CFF (Germany).

In a preferred embodiment, the amount of resin compared to the amount of refined fibres, e.g., white fibres, in the dry powder layer is higher than about 100%, preferably above about 120% and most preferably in the range of about 120% to 180%. Such ratios have the effect that the processability is increased and that the stain resistance is improved.

A sublayer, a layer scattered on the core, in combination with the dry powder layer above the sublayer, gives even better processability such as embossing depth and higher gloss. In embodiments, the sublayer comprises wood fibres, preferably natural wood fibres or HDF fibres, though refined fibres may be used, and a resin. In a preferred embodiment, the amount of resin compared to the amount of wood fibres is less than about 100%, preferably below about 200%, more preferably below about 300%, and possibly even below about 400%.

A top layer of refined fibres, without any aluminium oxide, placed above the dry powder layer further improves the stain resistance. It also increases the lifetime of the press plates.

Embodiments of the disclosure include the following combination of layers: (1) a sublayer and a dry power layer; (2) a dry powder layer and a top layer; and (3) a sublayer a dry powder layer and a top layer.

It is also possible to use a mix of refined fibres and HDF fibres or any natural wood fibres, i.e., wood fibres that are not refined, in order to decrease the cost and or create other colours.

Many combinations of the ingredients can be made into fully functional products. Two examples are given as to show two functional prototypes of the innovation.

BRIEF DESCRIPTION OF THE DRAWINGS

The disclosure will in the following be described in connection to preferred embodiments and in greater detail with reference to the appended exemplary drawing, wherein:

FIG. 1 Illustrates a floor panel according to an embodiment of the disclosure.

DETAILED DESCRIPTION OF EMBODIMENTS

A panel 1 is provided with a wood fibre based core 6, a homogenous non-transparent decorative surface layer 5 and preferably a balancing layer. The panel 1 is in one embodiment integrally formed in a production process where the surface layer, the core and the balancing layer are formed in the same pressing operation.

FIG. 1 shows the surface layer 5. It comprises a mixture of refined fibres 14, small hard wear resistant particles 12, 12' and a binder 19. The wear resistant particles (12,12') are preferably aluminium oxide particles.

The surface layer comprises also colour pigments 15 and/or, optionally, other decorative materials or chemicals. Decorative materials include, for example, materials that may affect design aspect(s) the surface layer. Exemplary design materials include materials effecting texture, reflectivity, shine, luminescence, transparency, etc.

Embodiments of the disclosure offer the advantage that the wear resistant surface layer 5 could be made much thicker than in the known laminated floor panels.

A preferable binder is melamine or urea formaldehyde resin. Any other binder, preferably synthetic thermosetting resins, could be used.

In the method according to embodiments of the invention preferably the same scattering and pressing units as disclosed in WO 2009/065769 are used, preferably together with a structured press plate in the method.

Example W1

Bright White Formulation

On a HDF board with a thickness of 9.8 mm, two backing papers NKR 140 where fixed on backside for balancing, a WFF powder formulation was added, consisting of 40 Wt % refined fibre, 10 Wt % aluminium oxide, 10 Wt % titanium dioxide as pigment and 40 Wt % melamine resin. The WFF powder mix was applied by a so-called scattering machine, which distributed the WFF powder material evenly over the HDF surface. The total amount of WFF powder was 625 g/m$^2$. The WFF powder was fixed on the HDF board by spraying a water solution consisting of 97 Wt % de-ionized water, 1 Wt % BYK-345 (wetting agent added to reduce surface tension) and 2 Wt % of Pat 622/E (release agent) on the WFF powder.

The above material was placed into a so-called DPL press. The surface texture consists of a special press plate with hills and valleys with about 300 microns in difference in highest and lowest part. This deep press plate cannot be used when pressing DPL and HPL, the melamine impregnated papers cracks during the pressing. The resulting product is a bright white building panel.

Further examples of powder mixtures are listed below.

| Type | W1 | W2 | W3 | W4 | Sublayer | W5 |
|---|---|---|---|---|---|---|
| HDF Fibre Wt % | 0 | 0 | 0 | 0 | 75 | 0 |
| White Fibre Wt % | 40 | 40 | 35 | 30 | 0 | 39 |
| Prefere 4865 Wt % | 0 | 40 | 45 | 52 | 25 | 0 |
| Kauramine 773 Wt % | 40 | 0 | 0 | 0 | 0 | 50 |
| TiO2 Wt % | 10 | 10 | 10 | 9 | 0 | 11 |
| Al2O3 Wt % | 10 | 10 | 10 | 9 | 0 | 0 |
| Total Wt % | 100 | 100 | 100 | 100 | 100 | 100 |

In the mixtures above Prefere 4865 and Kauramine 773 are used, which are examples of melamine formaldehyde resins.

For W3 and W4 the weight ratio of resin compared to the White Fibres (refined fibres) is increased. The increased ratio has the effect that the processability is increased and that the stain resistance is improved. In a preferred embodiment the weight ratio of resin compared to the White Fibres is higher than about 100%, preferably above about 120% and most preferably in the range of about 120% to 180%.

A sublayer, a layer scattered on the core, in combination with any one of the layers W1-W4 above the sublayer gives even better processability such as embossing depth and higher gloss.

A top layer, such as W5, without any aluminium oxide above any one of the layers W1-W4 further improves the stain resistance. It also increases the life time of the press plates.

Example R2

Colourful Red Formulation

On a HDF board with a thickness of 9.8 mm, two backing papers NKR 140 where fixed on backside for balancing, a WFF powder formulation was added, consisting of 42.5 Wt % refined fibre, 10 Wt % aluminium oxide, 5 Wt % Heucosin Spez. Tomatenrot G 10138 as red pigment and 42.5 Wt % melamine resin. The WFF powder mix was applied by a so-called scattering machine, which distributed the WFF powder material evenly over the HDF surface. The totally amount of WFF powder was 625 g/m$^2$. The WFF powder was fixed on the HDF board by spraying a water solution consisting of 97 Wt % de-ionized water, 1 Wt % BYK-345 (wetting agent added to reduce surface tension) and 2 Wt % of Pat 622/E (release agent) on the WFF powder.

The above material was placed into a so-called DPL press. The surface texture consists of a special press plate with hills and valleys with about 300 microns in difference in highest and lowest part. This deep press plate cannot be used when pressing DPL and HPL, the melamine impregnated papers cracks during the pressing. The resulting product is a colourful plain red building panel not easily obtained without the refined fibre.

The water solution sprayed on the WFF powder may include, for example, 80-100 Wt % water, preferably de-ionized water, 0-10 Wt % of a wetting agent, and 0-10% of a release agent. More preferably, the water solution may include, for example, 95-98.5 Wt % water, preferably about 97 Wt %, 0.5-2 Wt % wetting agent, preferably about 1 Wt %, and 1-3 Wt % release agent, preferably about 2 Wt %.

The invention claimed is:

1. A building panel comprising:

a carrier; and a colorful or white, non-transparent surface layer arranged on the carrier, wherein the surface layer is formed from a mix comprising refined fibres, pigments and a resin, wherein the weight ratio of resin to refined fibres is higher than about 120%, wherein the surface layer is a cured layer, wherein the surface layer is applied as a dry powder layer, and wherein the surface layer possesses between 30-40% refined fibres by weight, and wherein the surface layer is 0.2-1.0 mm thick.

2. The building panel according to claim 1, wherein the mix forming the surface layer further comprises wear resistant particles.

3. The building panel according to claim 1, wherein the pigments in the mix forming the surface layer comprises inorganic pigments, organic pigments or a combination thereof.

4. The building panel according to claim 1, wherein the carrier is a wood fibre based core.

5. The building panel according to claim 4, wherein the surface layer is attached to the wood fibre based core to obtain a building panel, wherein the core comprises a major part of the panel.

6. The building panel according to claim 4, wherein the building panel is a floor panel.

7. The building panel according to claim 4, wherein the carrier is an HDF panel.

8. The building panel according to claim 1, wherein the weight ratio of resin compared to refined fibres is in the range of about 120% to about 180%.

9. The building panel according to claim 4, wherein a balancing layer is applied to a surface of the wood fibre based core that is opposite to the surface layer.

10. The building panel according to claim 1, wherein a sublayer is arranged between the carrier and the surface layer.

11. The building panel according to claim 10, wherein the sublayer comprises a mix of wood fibres and a resin.

12. The building panel according to claim 1, wherein the surface layer is white.

13. The building panel according to claim 1, wherein the surface layer is devoid of wear resistant particles.

* * * * *